United States Patent [19]

Singer

[11] 4,332,372

[45] Jun. 1, 1982

[54] HOISTING DEVICE

[76] Inventor: Edouard Singer, 53, rue de Mulhouse, 68790 Morschwiller-Le-Bas, France

[21] Appl. No.: 235,552

[22] Filed: Feb. 18, 1981

Related U.S. Application Data

[63] Continuation-in-part of Ser. No. 927,364, Jul. 24, 1978, Pat. No. 4,264,056.

[30] Foreign Application Priority Data

Jul. 27, 1977 [FR] France ..... 77 23696

[51] Int. Cl.[3] ..... B66D 3/04

[52] U.S. Cl. ..... 254/391; 114/218; 188/65.1

[58] Field of Search ..... 254/391, 402, 408; 188/65.1, 65.2, 65.4; 114/218; 242/99

[56] References Cited

U.S. PATENT DOCUMENTS

| | | | |
|---|---|---|---|
| 666,879 | 1/1901 | White | 188/65.3 |
| 2,343,086 | 2/1944 | Schultz | 254/391 |
| 4,266,498 | 5/1981 | Clark | 114/218 |

FOREIGN PATENT DOCUMENTS

| | | | |
|---|---|---|---|
| 9262 | 11/1894 | Switzerland | 188/65.2 |

*Primary Examiner*—Billy S. Taylor

*Attorney, Agent, or Firm*—Robert E. Burns; Emmanuel J. Lobato; Bruce L. Adams

[57] ABSTRACT

A hoisting device, in particular a block, comprises a case having a shorter side and a longer side. A rotatable sheave is rotatably mounted in the case on a shaft that extends between the two sides and projects beyond the shorter side. Two fixed sheaves are mounted on the projecting portion of the shaft. A brake shoe slidably mounted on the longer side of the case below the rotatable sheave is slidable between an upper portion in engagement with the sheave and a lower position disengaged from the sheave. In hoisting condition, a rope passes over the rotatable sheave. In lowering condition, the rope passes from the rotatable sheave, down under the brake shoe and then over the inner non-rotating sheave, thereby pulling the brake block up against the rotatable sheave. In locked position, the rope further passes from the inner non-rotatable sheave around the outer non-rotatable sheave.

10 Claims, 7 Drawing Figures

HOISTING DEVICE

REFERENCE TO PRIOR APPLICATION

This application is a continuation-in-part of my application Ser. No. 927,364 filed July 24, 1978 now U.S. Pat. No. 4,264,056.

BACKGROUND OF THE INVENTION

The present invention relates to a hoisting device in particular a block having provisions for raising a load and for lowering a load with a braking function, so that the descent of the load can be controlled with relatively small force.

In my application, Ser. No. 927,364 now U.S. Pat. No. 4,264,056 there is disclosed a block comprising a case having a two spaced sides and a top portion connecting the sides and provided with means for suspending the block from a support. A rotatable sheave is rotatably supported in the case by a fixed shaft which extends between the sides of the case and projects outwardly of one of the sides. A braking sheave is fixed non-rotatably on the projecting portion of the shaft. For a hoisting operation, a rope is passed over the rotatable sheave so that a force applied on one end of the rope will hoist a load suspended on the other end. For lowering operation, the rope passes through a notch at the lower side of the case and up over the fixed braking sheave, thereby making it possible to exert a snubbing effect on the rope. A cover of elastomeric material on the outer face of the fixed sheave has a rim which is directed in towards the case so as to assure the holding fast of the rope on the fixed sheave.

SUMMARY OF THE INVENTION

The present invention is directed to a further improvement of the hoisting device disclosed in my prior application, Ser. No. 927,364 now U.S. Pat. No. 4,264,056. In accordance with the invention, a second fixed sheave is provided on the outboard side of the braking sheave. Moreover, one side of the case of the block is made longer than the other and on the longer side the braking shoe is mounted for movement in a vertical direction. On its lower side, the braking shoe has a groove to receive the rope, while on the upper side of the braking shoe there is a semi-toroidal portion of non-slip material adapted to be pressed into the groove of the rotatable sheave. For a lowering operation, the rope passes from the rotatable sheave down under braking shoe and then up over the braking sheave. The braking shoe is thereby drawn up against the rotatable sheave to exert a braking action, in addition to the snubbing action provided by the braking sheave. In order to lock the rope, it is further passed around the second fixed sheave which preferably comprises two parts which are resiliently pressed toward one another, so as to grip the rope more firmly.

BRIEF DESCRIPTION OF DRAWINGS

The nature, objects and advantages of the invention will be more fully understood from the following description of preferred embodiments shown by way of example in the accompanying drawings in which.

DESCRIPTION OF PREFERRED EMBODIMENTS

Figure 1:
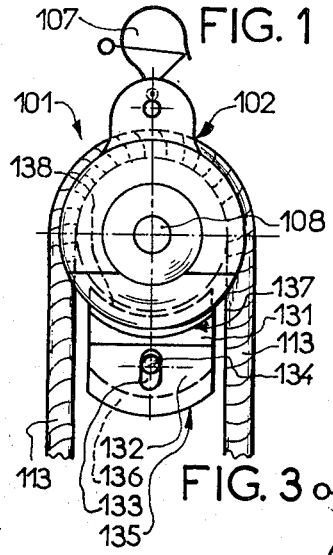
FIG. 1 is a front elevation of a hoisting device in accordance with the invention as shown in normal hoisting operation.

The hoisting device 101 shown by way of example in FIGS. 1 to 6, comprises a case 102 having two vertical sides 103 and 104 spaced from one another. The upper portions 105 of the vertical sides 103, 104 are travered by a pin 106 serving to join the case 103 with a supporting number 107, such as a hook. The two sides 103, 104 are traversed by a shaft 108 which rotatably supports a sheave 109 between the two sides of the case. The shaft 108 projects laterally beyond one side 104 of the case.

A first fixed sheave $\mathbf{114_1}$ applied to the outer face 126 of the vertical side 104 of the case is mounted on the projecting portion of the shaft 108. The first fixed sheave $\mathbf{114_1}$ has a perpherial groove 127 to receive the rope 113. A cap $\mathbf{121_1}$ of resilient material, for example an elastomer is provided on the outer face of the first fixed sheave $\mathbf{114_1}$ and has an inturned rim portion $\mathbf{122_1}$ which assists in retaining the rope 113 in the groove 127. The fixed sheave $\mathbf{114_1}$ has a straight lower edge 128, which is located in the same horizontal plane as the lower edge 129 of the vertical side 104 of the case.

Disclosed against the outer face 130 of the first fixed sheave $\mathbf{114_1}$ there is a second fixed sheave $\mathbf{114_2}$ likewise mounted on the projecting portion of the shaft 108. The second fixed sheave $\mathbf{114_2}$ has two frustoconical flanks $\mathbf{116_1}$ and $\mathbf{116_2}$ of which the small bases $\mathbf{119_1}$ $\mathbf{119_2}$ are integral with a hub 120. The spacing of the frustoconical flanks $\mathbf{116_1}$, $\mathbf{116_2}$ is such that the rop 113—when passed around the second fixed sheave—wedges between the flanks so as to be gripped more securely. On the outer face of the second fixed sheave $\mathbf{114_2}$ there is a cap $\mathbf{121_2}$ preferably of elastomeric material having an in turned rim portion $\mathbf{122_2}$ which assists in retaining the rope in the groove formed by the flanks $\mathbf{116_1}$, $\mathbf{116_2}$ of the second fixed sheave $\mathbf{114_2}$.

Figure 2:
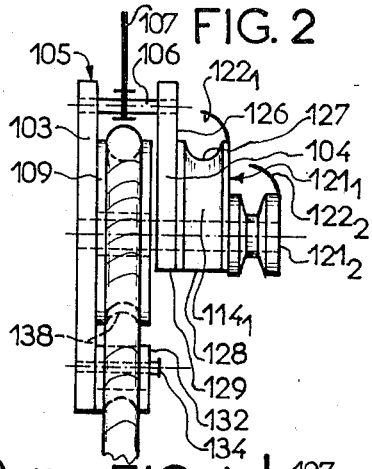
FIG. 2 is a side view of the hoisting device shown in FIG. 1.

As seen in FIG. 2, the vertical side 103 of the case 102 extends down beyond the lower edge 129 of the vertical side 104. On the interface of a lower portion of the side 103 of the case, there is mounted a brake-forming shoe 131. The shoe 131 made of antislip material, in particularly rubber, is mounted on a fiberglass sliding plate 132. The plate 132 is provided with a vertical transverse slot 133 through which passes a stud shaft 134 by which the plate 132 is mounted on the inner face of the vertical side 103 of the case 102.

The lower part 135 of the brake shoe 131 is formed as a semi-sheave provided with a groove 136 adapted to receive the rope 113. On the upper part of the brake shoe 131, there is formed a semi-torroidal boss 138 adapted to engage in the groove 112 of the rotatable sheave 109. The vertical groove 133 in the sliding plate 132 provides for movement of the brake shoe between an upper position in which it engages the rotatable sheave 109 and a lower position in which it is disengaged from the sheave.

In normal use of the hoisting device 101 for a hoisting operation, the rope 113 passes partially around the rotatable sheave 109 as illustrated in FIGS. 1 and 2. In this condition a load on one end of the rope can be raised by applying a force to the other end of the rope.

Figure 3:
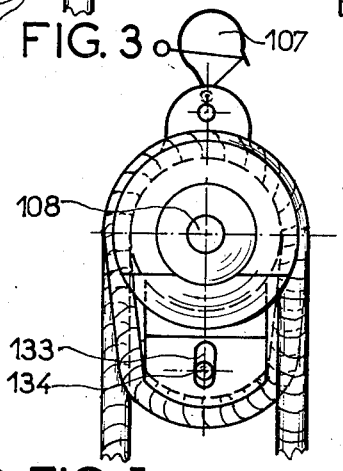
FIG. 3 is an elevation of the hoisting device shown as used in a lowering operation.
Figure 4:
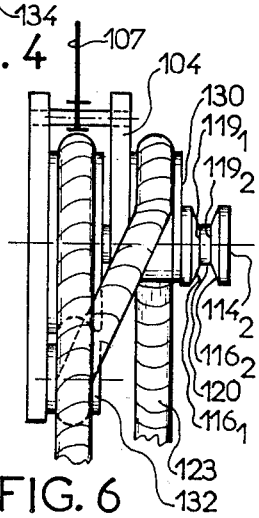
FIG. 4 is a side view of the hoisting device as shown in FIG. 3.

In the operation of lowering a load, a portion 123 of the rope 113 is brought down around the brake shoe 131 engaging in the groove 136 and then up over the fixed sheave $114_1$ as illustrated in FIGS. 3 and 4. Under the effect of the force applied to the rope 113, the assembly of the plate 132 and brake shoe 131 is slid upwardly so that the semi-torroidal boss 138 engages in the groove 112 of the rotatable sheave 109 thereby applying a braking action to the sheave. The passage of the rope 113 from the brake shoe 131 up over the fixed sheave $114_1$ is possible by reason of the fact that the lower edge 128 of the fixed sheave $114_1$ and the lower edge 129 of the vertical side 104 of the case are in the same horizontal plane.

Figure 5:
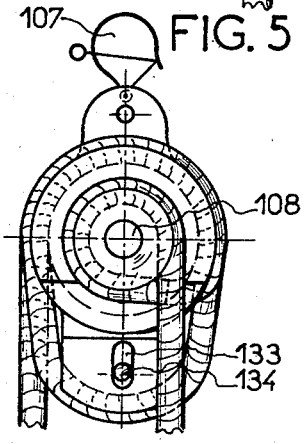
FIG. 5 is an elevation showing the hoisting device in a locking condition.
Figure 6:
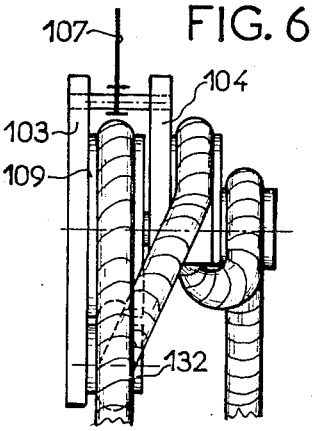
FIG. 6 is a side view of the hoisting device shown in FIG. 5.

In order to lock the hoisting device 101, the rope is further passed from the first fixed sheave $114_1$ over the second fixed sheave $114_2$ as shown in FIGS. 5 and 6. A load on the other end of the rope can thereby be held securely.

Figure 7:
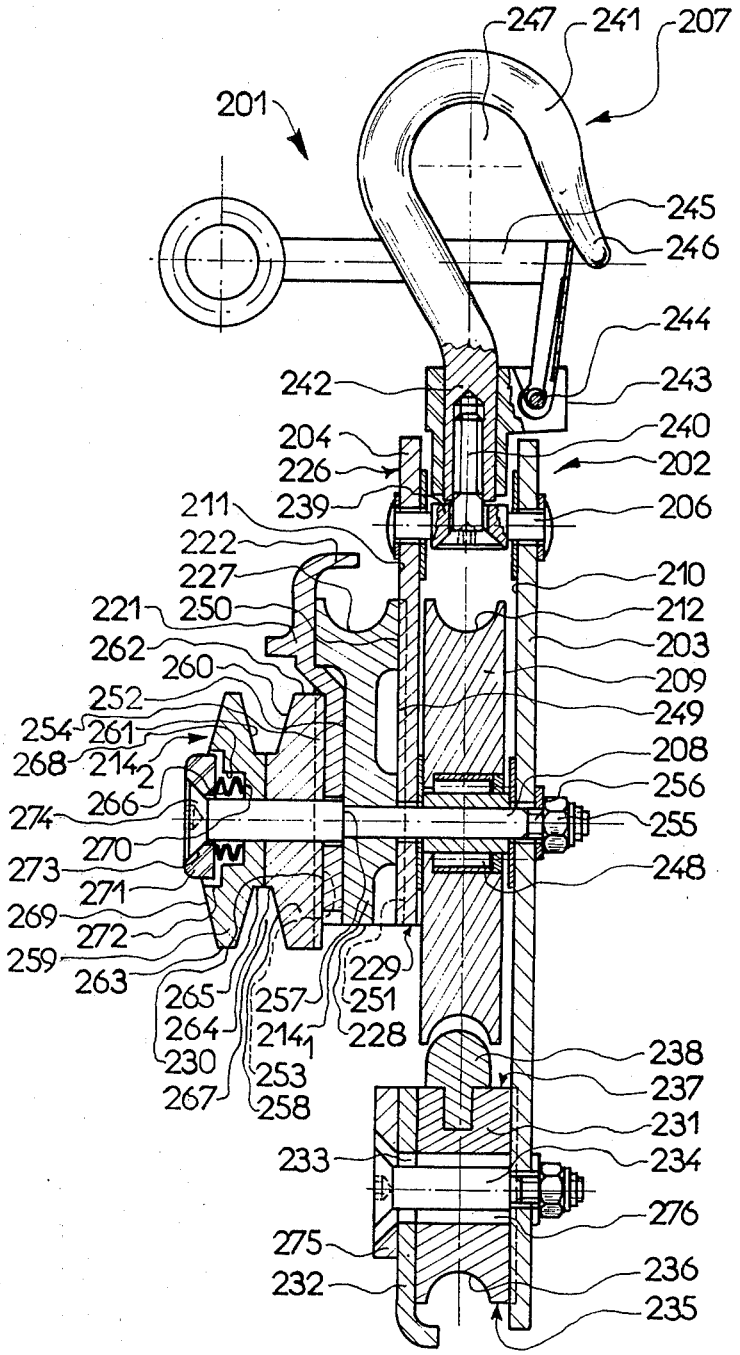
FIG. 7 is a vertical section of another embodiment of the hoisting device in accordance with the invention.

In FIG. 7 there is shown a hoisting device 201 comprising a case 202 composed of two vertical sides 203, 204. Upper portions of the sides 203, 204 are traversed by a pin 206 on which is threaded a member 239 traversed vertically by a threaded shaft 240 on which is screwed a hook 241 of the supporting member 207. On a branch 242 of the hook 241 is threaded a bushing 243 traversed by a shaft 244 providing connection between the bushing 243 and a latch element 245 which cooperates with the point 246 of the hook to prevent a rope by which the block is supported from coming out of the eye 247 of the hook 241.

The two vertical sides 203, 204 of the case are traversed by a shaft 208. On the shaft 248 between the inner faces 210, 211 of the vertical sides 203, 204, there is a needle bearing 248 serving to mount a rotatable sheave 209 on the shaft 208. The shaft 208 projects beyond the side 204 of the case and serves equally to support a first fixed sheave $214_1$. The fixed sheave $214_1$ is held against rotation by a tongue 249 on the outer face 226 of the vertical side 204 engaging in a groove 250 provided in the inner face 251 of the fixed sheave $214_1$. On the outer face 252 of the fixed sheave $214_1$ is applied a cap 221 of elastomeric material. The cap 221 has an in turned rim portion 222 which extends in over the periphery of the first fixed sheave $214_1$ to retain a rope in the groove 227 of the sheave. The elastomeric cap 221 has on its outer face 230 a groove 253 in which is engaged a tongue 254 of a second fixed sheave 214 mounted on the projected portion of the shaft 208.

Lateral displacement of the shaft 208 is prevented on the one hand by a nut 255 screwed on the threaded end 256 of the shaft and, on the other hand, by a shoulder 257 which is applied against the outer face 252 of the first fixed sheave $214_1$.

The second fixed sheave $214_2$ is composed of two cheeks 258, 259. Each of the cheeks 258 and 259 has a frustoconical flank 260, 261 abutting, on the one hand, cylindrical outer surfaces 262, 263 and, on the other hand, shoulders 264, 265. The two shoulders 264, 265 face one another and are pressed toward one another by the action of at least one elastic element 266. The two frustoconical flanks 260, 261 form between them a groove 267 in which the rope can be received. The elastic element 266 disposed in a recess 268 provided in the outer face 269 of the outer cheek 259 is maintained on the one hand by the bottom 270 of the recess 268 and, on the other hand, by a lock washer 271 slidable in an enlargement 272 of the recess 268. The lock washer 271 is countersunk to receive the conical head 274 of the shaft 208.

When a free portion of the rope is wound around the second fixed sheave $214_2$, the outer cheek 259 is pressed outwardly from the cheek 258 and the elastic element 266 is compressed. When the traction exerted on the free end of the rope is released, the elastic element 266 acts to push the outer cheek 269 against the inner cheek 258. In this manner the free portion of the rope is gripped between the two frustoconical flanks 260, 261.

The hoisting device 201 further comprises a brake shoe 231 traversed by a shaft 234 serving to mount the brake shoe on the downwardly extending portion of the vertical side 203. Threaded on the shaft 234 is a plate 232 maintained by a lock washer 275. The brake shoe 231 has a vertical slot 276. Moreover, the plate 232 is provided with a slot 233 as is also the lock washer 275. In this manner the assembly formed of the shoe 231, the plate 232 and the lock washer 275 can slide vertically on the side 203 of the case. The shoe 231 has on its lower part a groove 236 in which the rope can be received. On its upper part 237 the shoe 231 has a semi-torroidal boss 238 which is engageable in the groove 212 of the rotatable sheave 209 to exert a breaking action on the latter.

The hoisting device shown in FIG. 7 is used in the same manner as described above with reference to the hoisting device shown in FIGS. 1–6.

While preferred embodiments of the invention have been illustrated in the drawings and are herein particularly described, it will be understood that modifications may be made and that the invention is thus not limited to the illustrated embodiments.

What is claimed is:

1. A hoisting device, in particular a block, comprising a case having spaced first and second sides, means at the top of said case for suspending said case from a support, a shaft extending between said sides of said case and projecting beyond said first side thereof, a rotatable sheave disposed between said sides of said case and rotatably supported by said shaft, a first non-rotatable sheave fixed on said shaft against an outer face of said first side of said case, a second non-rotatable sheave fixed on said shaft against an outer face of said first non-rotatable sheave, a brake shoe mounted for vertical movement on an inner face of said second side of said case below said rotatable sheave, said brake shoe having on its lower face a rope-receiving groove and having on its upper face a convex portion for engagement with the groove of said rotatable sheave, said brake shoe being movable between an upper position in which it engages said rotatable sheave and a lower position in which it is disengaged from said rotatable sheave, and a rope which in hoisting condition passes over said rotatable sheave, in lowering condition passes from said rotatable sheave down under said brake shoe, then up over said first non-rotatable sheave and in locked condition further passes around said second non-rotatable sheave.

2. A hoisting device according to claim 1, in which said first side of said case is shorter than said second side with a lower edge below said shaft, and in which said first non-rotatable sheave is parti-circular with a lower edge in the same horizontal plane as the lower edge of said first side of said case.

3. A hoisting device according to claim 1, in which a flexible cap between said first and second non-rotatable sheaves has a rim portion that extends over the periphery of said first non-rotatable sheave to retain said rope therein.

4. A hoisting device according to claim 3, in which said cap is formed on flexible elastomeric material.

5. A hoisting device according to claim 4, in which said cap and an inner face of said second non-rotatable sheave have inter-engaging abutting portions to hold said second non-rotatable sheave against rotation.

6. A hoisting device according to claim 1, in which said second non-rotatable sheave comprises first and second coaxial parts having facing frustoconical flanks defining a groove for said rope, said first part being axially movable on said shaft and resiliently pressed toward said second part.

7. A hoisting device according to claim 6, in which said shaft has a head portion and in which means for pressing said first part of said second non-rotatable sheave toward said second part comprises a spring acting between said head portion of said shaft and said first part of said non-rotatable sheave.

8. A hoisting device according to claim 1, in which said shaft extends through said second non-rotatable sheave, said first non-rotatable sheave, said first side of said case, said rotatable sheave and said second side of said case and has a head portion retaining said second non-rotatable sheave, a shoulder engaging said first non-rotatable sheave to press it against said first side of said case, and a threaded end projecting beyond said second side of said case and receiving a nut.

9. A hoisting device according to claim 1, in which said brake block has a parti-torroidal upper portion of non-slip material engageable in the groove of said rotatable sheave.

10. A hoisting device according to claim 1, in which said brake shoe is mounted on said second side of said case by means of a stud on said second side of said case received in a vertical slot in said brake shoe, said second side of said case and said brake shoe having interfitting tongue and groove portions providing for vertical movement of said brake shoe while preventing its rotational movement.

* * * * *